US005743530A

United States Patent [19]

Sklad et al.

[11] Patent Number: 5,743,530

[45] Date of Patent: Apr. 28, 1998

[54] METHOD AND APPARATUS FOR A CARD GAME

[75] Inventors: Alan T. Sklad; Daniel A. Sklad, both of Phoenix; George A. Wolfe, Tempe, all of Ariz.

[73] Assignee: Sklad Enterprises, Inc., Phoenix, Ariz.

[21] Appl. No.: 823,221

[22] Filed: Mar. 24, 1997

[51] Int. Cl.[6] ..... A63F 1/00

[52] U.S. Cl. ..... 273/274; 273/292; 273/309

[58] Field of Search ..... 273/274, 309, 273/292, 303, 306

[56] References Cited

U.S. PATENT DOCUMENTS

| | | | |
|---|---|---|---|
| 4,651,997 | 3/1987 | Wood | 273/274 |
| 5,288,081 | 2/1994 | Breeding | 273/292 |
| 5,314,193 | 5/1994 | Ferrer | 273/292 |
| 5,322,295 | 6/1994 | Cabot et al. | 273/274 |
| 5,397,128 | 3/1995 | Hesse | 273/292 |
| 5,411,257 | 5/1995 | Folton | 273/274 |
| 5,417,430 | 5/1995 | Breeding | 273/292 |
| 5,431,408 | 7/1995 | Adams | 273/292 |
| 5,437,462 | 8/1995 | Breeding | 273/292 |
| 5,503,401 | 4/1996 | Nguyen | 273/306 |
| 5,544,892 | 8/1996 | Breeding | 2783/292 |

*Primary Examiner*—William M. Pierce
*Attorney, Agent, or Firm*—Frank J. McGue

[57] ABSTRACT

A game for a number of players comprises providing a deck of cards having fifty-one cards. The deck includes three jokers in combination with forty-eight cards organized in four suits, each suit having in six pairs of cards of the same type, wherein five of the types are sequential while the sixth type is not sequential with the other five. Each player places a first wager to participate in the wagering game. Each player is dealt two cards while a hole card is dealt for the table. All cards are dealt face down. Each player is given the chance to double down the first wager with a second wager. A hand is provided for each player with each hand comprising the hole card and the two cards each player was dealt. The first and second wagers are resolved based on said hand, wherein if a player's hand comprises a predetermined arrangement of cards, that player wins a corresponding preselected amount.

14 Claims, 2 Drawing Sheets

METHOD AND APPARATUS FOR A CARD GAME

TECHNICAL FIELD

This invention relates in general to games of chance, and, more particularly, to a method and apparatus for a card game that can be played using a modified pinochle deck of cards or by video game machinery.

BACKGROUND OF THE INVENTION

Over the last ten years the gaming industry has expanded dramatically, both nationally and internationally. Slot machines and video games have taken the lead with regard to revenue production, capturing up to 70% in some markets. Partially responsible for this trend is the creativity and imagination that electronic devices command as well as the large jackpots offered with the machines.

Table games, however, have remained quite basic. Blackjack, craps, roulette and poker are the norm, with baccarat and other specialty games filling particular needs. Despite attempts by various equipment suppliers and manufacturers, variations of these games have not been particularly successful. Generally, the variations fail because they are too complicated for the average gaming person to understand.

A few successes have occurred for some games such as Pai Gow Poker, Double Down Stud, Let-It-Ride Blackjack, Fast Action Hold 'Em and Caribbean Stud Poker. These games tend to be fairly simple to understand and some offer progressive jackpots that can grow to impressive amounts.

U.S. Pat. No. 5,288,081 entitled "Progressive Wagering Method and Game" which issued on May 23, 1995 to Breeding discloses a playing card wagering game in which there are seven positions and a dealer. Cards are dealt, face down, three to each player and two to the dealer. There is then a series of progressive betting as each player uses his cards in combination with those of the dealer. There are odds for the many possible poker hands.

U.S. Pat. No. 5,397,128 entitled "Casino Card Game" which issued on Mar. 14, 1995 to Hesse et al. discloses a casino card game using a modified deck of cards including numbered cards 2 through 6 and 9 along with the honor cards.

U.S. Pat. No. 5,503,401 entitled "Method of Playing a Card Game" which issued on Apr. 2, 1996 to Nguyen discloses another card game with a modified deck of cards. Each modified conventional deck has an additional four jokers and has all 7,8, 9 and 10 cards removed.

U.S. Pat. No. 5,314,193 entitled "Method of Playing a Wagering Casino Type" which issued May 24, 1994 to Ferrer shows a casino card game in which each player is dealt two cards and at least one additional card after placing a wager.

The known prior art is described above. None of the known prior art disclose the game set forth herein.

SUMMARY OF THE INVENTION

In accordance with the invention claimed, one object of this invention is to provide a new table game for use in the gaming industry.

It is another object of this invention to provide a new video game for use in the gaming industry.

It is still another object of the invention to provide a novel game which combines a slot machine with a three card variation of poker which provides for progressive betting during the course of the game.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
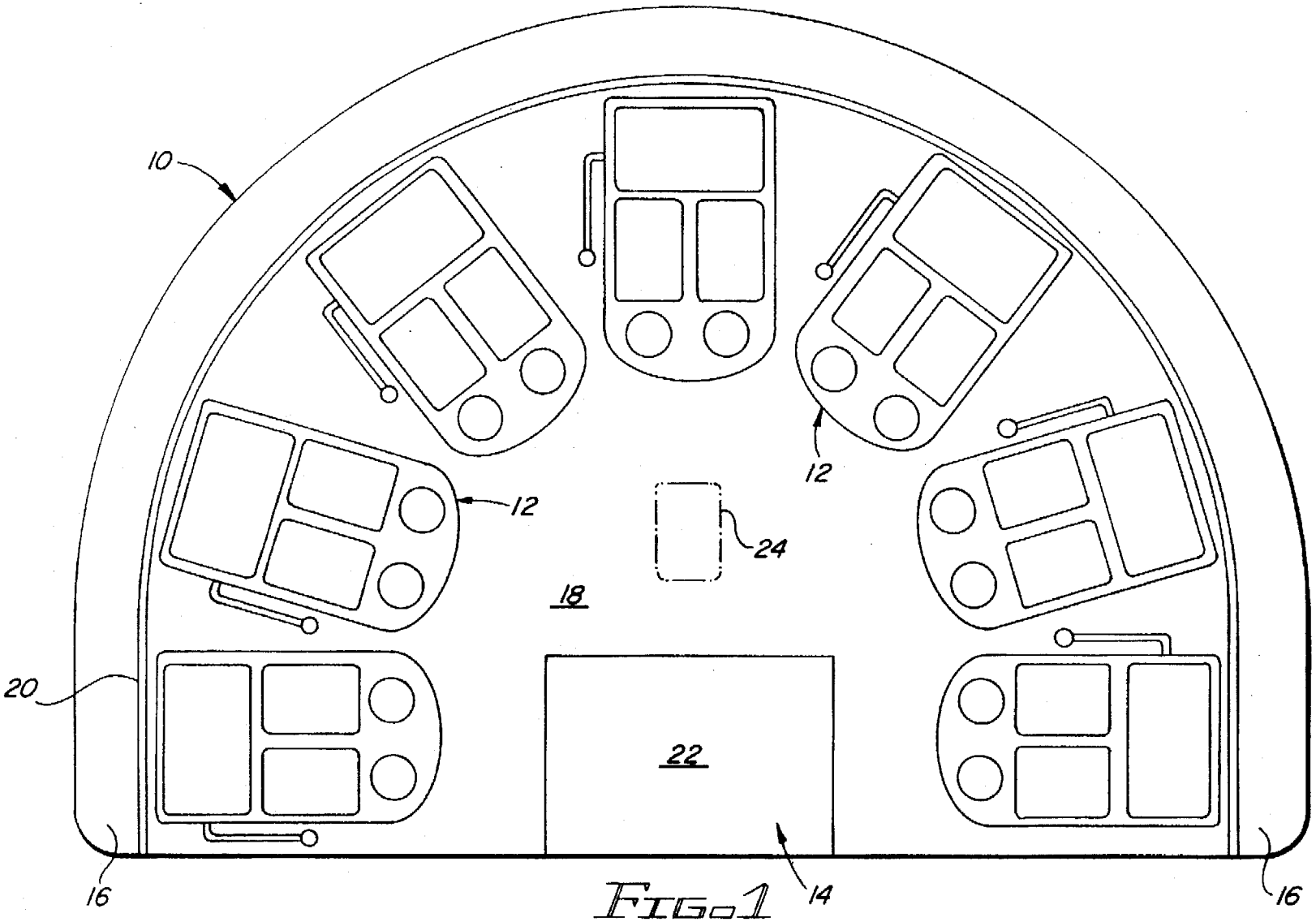
FIG. 1 is a top view of a gaming table used in the present invention.
Figure 2:
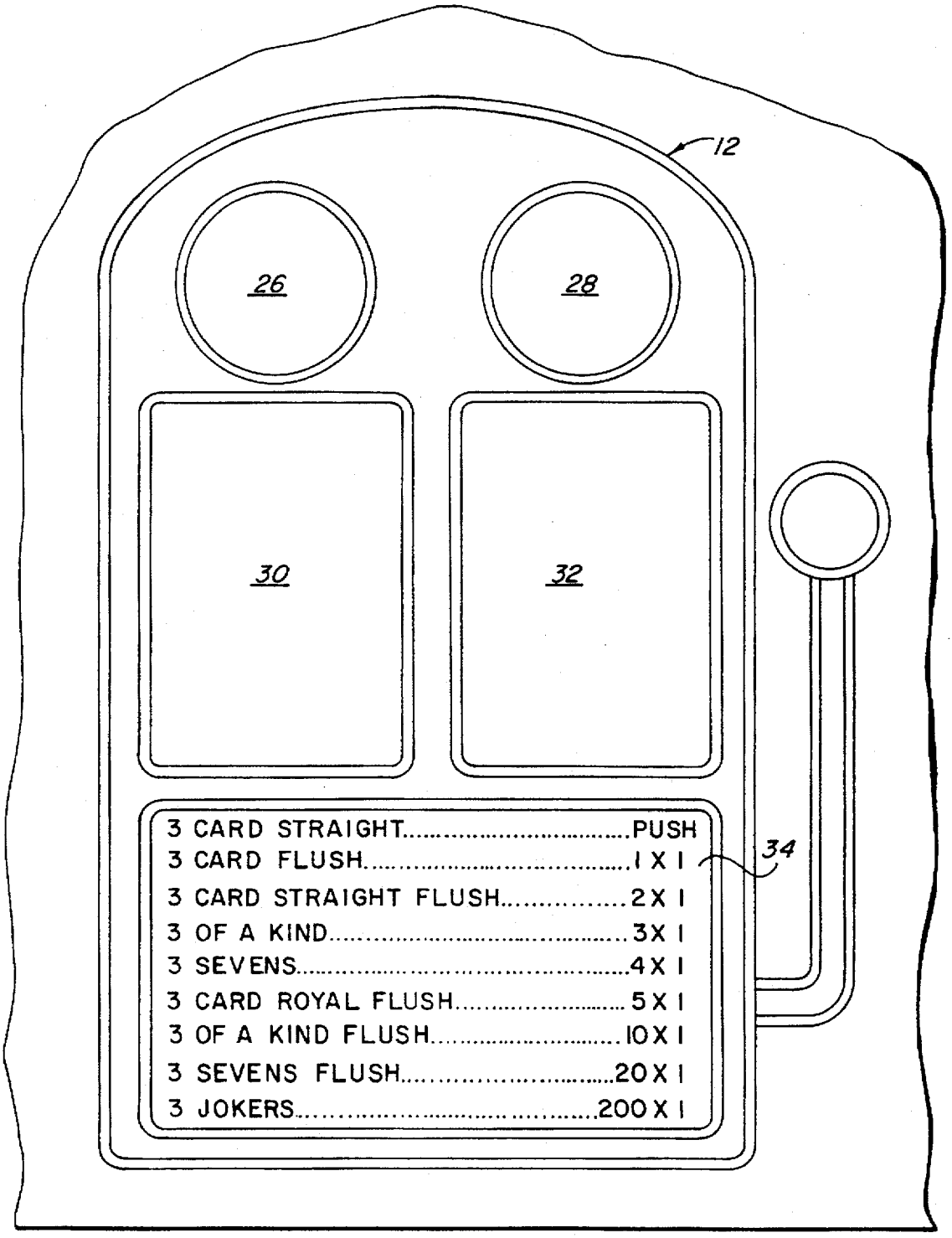
FIG. 2 is an expanded view of one of the player's stations of FIG. 1.

In accordance with the invention claimed, FIGS. 1–2 disclose a novel JOKER IN THE HOLE™ table game and apparatus therefore. As shown in FIG. 1, the game is played on a gaming table 10 which comprises a plurality of playing stations 12 and a dealers' station 14. Gaming table 10 is semicircular in shape having rounded corners 16. In the presently preferred embodiment, table 10 includes a flat, recessed central surface 18 which is surrounded by a rail 20.

In the illustrated embodiment, seven (7) playing stations 12 are provided, though variations on this number are obviously possible. The game as described can have a minimum of one or a maximum of twenty-five (25) players participating. However, the presently preferred embodiment of seven playing stations 12 provides a game manageable by a single dealer.

Dealer's station 14 includes a open area 22 for shuffling cards, storing chips and the like and a hole card position 24. Use of hole card position 24 is described in more detail below.

As best seen in FIG. 2, each player station 12 comprises a simulated representation of a slot machine. At the top of the simulation, two betting circles 26 and 28 are positioned. Underneath betting circles 26 and 28 are positioned two card rectangles 30 and 32, respectively. Card rectangles 30 and 32 are sized to receive standard playing cards therein as best described below.

Underneath card rectangles 30 and 32 and extending the width of playing station 12 is large odds rectangle 34. Preferably, indicia contained therein a list of the possible predetermined winning card combinations and the corresponding preselected payoff schedules relating thereto. Such preselected payoff schedules are changeable at the discretion of the casino as those skilled in the art will recognize.

It will be understood by those skilled in the art that the arrangement and positioning of betting circles 26 and 28, card rectangles 30 and 32, as well as the use of odds rectangle 34, is not critical to the invention. Many other variations of this arrangement are possible.

The game is played with a modified pinochle deck comprising fifty-one cards including forty-eight (48) cards of four (4) suits each. Preferably, the four (4) suits are the typical spades, hearts, diamonds and clubs. In addition, three (3) jokers are included in the deck. The following lists the presently preferred distribution of cards within each deck:

| | |
|---|---|
| 3 Jokers | |
| 8 Aces- | 2 from each suit |
| 8 Kings- | 2 from each suit |
| 8 Queens- | 2 from each suit |
| 8 Jacks- | 2 from each suit |
| 8 Tens- | 2 from each suit |
| 8 Sevens- | 2 from each suit |

The use of sevens instead of nines is one variation from the standard nines available in a pinochle deck. It will be understood by those skilled in the art that key to the game described below is the use of three (3) jokers in combination with forty-eight (48) cards in four (4) suits organized in six (6) blocks of eight (8) cards of the same type (ace, king, queen, ten, etc), each wherein five of the types are sequential while the sixth type is not sequential with the other five. Thus, the game can be played using, for example, fives through nines and threes instead of tens through aces and sevens.

To play the game, the players will place their initial wages using one of two options. In the first option, all players will place their initial wager in betting circle 26 as well as an equal double down wager in betting circle 28. In the second option, all players simply place the initial wage in betting circle 26.

The dealer shuffles the cards and deals, clockwise and face down, two cards into card rectangles 30 and 32 for each player as well as one hole card into hole card position 24. Each player will inspect their two cards and decide whether to make the additional wager or not. In the first betting option, the player must withdraw the wager placed in betting circle 28 if a double down wager is not elected; otherwise, the double down wager is placed by default. In the second option, the player must place a wager in betting circle 28 if the double down wager is elected; otherwise, the double down wager is not placed by default.

After the status of the double down wager is established for each player, the dealer reveals the hole card. The dealer resolves each player's bet based upon the payout schedule set forth by the casino in odds rectangle 34, including any additional wagers placed by the bettor. Bets made by non-winning hands are collected by the dealer for the house.

Those skilled in the art will recognize that the above game is easily adaptable to a video machine format.

Although only certain embodiments have been illustrated and described, it will be apparent to those skilled in the art that various changes and modifications may be made therein without departing from the spirit of the invention or from the scope of the appended claims.

What is claimed is:

1. A game for a one or more players comprising:

providing a modified pinochle deck of cards consisting of fifty-one cards, including three jokers in combination with forty-eight cards organized in four suits, each suit having six pairs of cards, each of the six pairs being of the same face value, wherein the face value of five of the pairs are aces, kings, queens, jacks and tens while the face value of the sixth pair is eight or less;

each player placing a first wager to participate in the game;

dealing two cards to each player and dealing a hole card;

giving each player the chance to double down the first wager with a second wager;

providing a hand for each player, the hand comprising the hole card and the two cards each player was dealt; and resolving each player's first and second wagers based on said hand, wherein if a player's hand comprises a predetermined arrangement of cards, that player wins a corresponding preselected amount.

2. The game set forth in claim 1 having from one to twenty-five players.

3. The game set forth in claim 1 wherein the four suits are spades, hearts, diamonds and clubs.

4. The game set forth in claim 3 wherein the non-sequential type is sevens.

5. The game set forth in claim 1 wherein the deck of cards is provided by a video game machine.

6. A modified pinochle deck of cards suitable for use in a casino game consisting of:

three jokers; and forty-eight cards organized in four suits, each suit having six pairs of cards, each of the six pairs being of the same face value, wherein the face value of five of the pairs are sequential while the face value of the sixth pair is eight or less.

7. The deck of cards of claim 6 wherein the four suits are spades, hearts, diamonds and clubs.

8. The deck of cards of claim 7 wherein the non-sequential type of cards is sevens.

9. A game table suitable for use in a game playable by one or more players, the game table comprising:

a surface, a dealer's station having means associated with the surface therewith for designating a hole card;

one or more player's stations having a simulated representation of a slot machine imprinted thereon, each simulated respresentation of a slot machine having means associated therewith for designating an amount each of said players desire to wager, each simulated respresentation of a slot machine having means associated therewith for designating whether each of said players desire to double down the amount; and each simulated respresentation of a slot machine having means associated therewith for designating two cards for play by each of said players.

10. The game table set forth in claim 9 comprising between two and twenty five playing stations.

11. The game table set forth in claim 10 comprising seven playing stations.

12. The game table set forth in claim 9 wherein the means associated therewith for designating the amount each of said players desire to wager is first betting circle and the means associated therewith for designating whether each of said players desire to double down the wager is a second betting circle.

13. The game table set forth in claim 9 wherein the means associated therewith for designating two cards for play by each of said players comprises two rectangles of playing card size.

14. The game table set forth in claim 9 further comprising an odds rectangle having indicia thereon, the indicia having a list of possible winning card combinations and a payoff schedule corresponding thereto.

* * * * *